US005525809A

United States Patent [19]

Bolea

[11] Patent Number: 5,525,809

[45] Date of Patent: Jun. 11, 1996

[54] ELECTRO-OPTIC SHEET-SENSING APPARATUS AND METHOD HAVING A MOVABLE LIGHT EMITTING ELEMENT

[75] Inventor: Phillip A. Bolea, White Bear Lake, Minn.

[73] Assignee: Minnesota Mining and Manufacturing Company, St. Paul, Minn.

[21] Appl. No.: 329,534

[22] Filed: Oct. 26, 1994

[51] Int. Cl.[6] ..... G01N 21/86

[52] U.S. Cl. ..... 250/559.27; 250/559.4; 271/265.04; 356/381

[58] Field of Search ..... 250/559.27, 559.4, 250/559.28; 217/262, 263, 265.01–265.04; 356/381–382; 33/501.02–501.04, 559–561

[56] References Cited

U.S. PATENT DOCUMENTS

| | | | |
|---|---|---|---|
| 3,917,142 | 11/1975 | Guarderas | 226/45 |
| 3,968,364 | 7/1976 | Miller | 250/559.27 |
| 4,549,808 | 10/1985 | Ernst | 356/374 |
| 4,550,252 | 10/1985 | Tee | 250/223 R |
| 4,650,991 | 3/1987 | Croset et al. | 250/223 R |
| 4,994,678 | 2/1991 | Sasaki | 250/223 R |
| 5,105,078 | 4/1992 | Nochise et al. | 250/223 R |
| 5,179,287 | 1/1993 | Kitajima et al. | 250/201.4 |
| 5,185,520 | 2/1993 | Kurata | 250/223 R |
| 5,204,537 | 4/1993 | Bennet et al. | 250/223 R |
| 5,250,803 | 10/1993 | Christ et al. | 250/223 R |
| 5,311,031 | 5/1994 | Gagliardo | 250/223 R |
| 5,313,070 | 5/1994 | Vala et al. | 250/223 R |
| 5,343,142 | 8/1994 | Sasaki et al. | 324/71.1 |
| 5,384,468 | 1/1995 | Milne et al. | 250/559.27 |

FOREIGN PATENT DOCUMENTS

| | | |
|---|---|---|
| 58-150972 | 9/1983 | Japan . |
| 58-172786 | 10/1983 | Japan . |
| 62-65864 | 3/1987 | Japan . |
| 63-185754 | 8/1988 | Japan . |
| 4-23741 | 1/1992 | Japan . |
| 4-164748 | 6/1992 | Japan . |

*Primary Examiner*—Edward P. Westin
*Assistant Examiner*—Que T. Le
*Attorney, Agent, or Firm*—Gary L. Griswold; Walter N. Kirn; William K. Weimer

[57] ABSTRACT

An apparatus and method electro-optically senses the presence of a sheet of material by positioning a member and a light emitter relative to the sheet so that the presence of the sheet causes movement of the member and light emitter. The light emitter can include an optical fiber which produces a light spot so that movement of the light emitted can be sensed by an electro-optic sensor based on the position of the light spot on a photosensitive zone within the electro-optic sensor. A sheet-feeding mechanism can be properly positioned to insure proper placement of the sheet.

20 Claims, 4 Drawing Sheets

ELECTRO-OPTIC SHEET-SENSING APPARATUS AND METHOD HAVING A MOVABLE LIGHT EMITTING ELEMENT

FIELD OF THE INVENTION

The present invention is directed generally to an apparatus and method for sensing the presence of a sheet of material within an apparatus, and is directed more specifically to an apparatus and method for electro-optically counting the number of sheets present within an apparatus.

BACKGROUND OF THE INVENTION

Sensing the presence of a sheet of material or counting the number of sheets within a sheet-handling apparatus, such as a photocopier, can be a critical task. In most cases, the apparatus is designed to process one sheet of material at a time. The failure by the apparatus to feed a sheet on demand is, at the least, inefficient. Feeding more than the one sheet is similarly inefficient. But, more importantly, feeding more than one sheet can cause a sheet to become lodged or jammed within the apparatus stopping the operation of the apparatus and, possibly, damaging internal mechanisms within the apparatus.

Known sheet-sensing applications which demand a relatively high degree of accuracy and sensitivity can involve apparatuses which are complicated, bulky, sensitive to shock and vibration, and costly. For example, the use of optical transmission through a sheet(s) is complicated if the opacity of the sheet varies significantly or if the sheet is sensitive and vulnerable to the light being transmitted.

The use of dielectric measurement is similarly complicated when the dielectric property within a sheet varies significantly. And, dielectric sensors are known to be bulky.

The use of wide aperture analog photointerrupters, which include mechanically amplified lever arms, requires precise alignment and are susceptible to electro-optical changes over time. With mechanical amplification, this approach is also more susceptible to vibration and shock inherent within the apparatus.

Besides occasionally failing to feed a single sheet, known apparatuses are often plagued with inaccurate placement when feeding or transporting a single sheet. Commonly, sheets are introduced into a sheet-handling apparatus from a sheet container which is inserted into the sheet-handling apparatus. One known sheet pick-up mechanism involves the use of suction cups to grasp the top sheet in the container and guide that top sheet to another location within the apparatus. However, the accuracy of the pick-up mechanism can be adversely affected by, for example, vibration within the sheet-handling apparatus and can result in the misplacement or misalignment of the sheet. Misplacement and/or misalignment can result in a sheet being lodged or jammed within the sheet-handling process, or simply processed poorly.

As a result of the problems noted above, there is a need for a sheet-sensing apparatus which provides accuracy and sensitivity without the above-mentioned shortcomings. Another need includes the ability to count the number of sheets present with an apparatus. Another need includes the ability to properly position, align, and/or guide a sheet within a sheet-handling apparatus.

SUMMARY OF THE INVENTION

The present invention overcomes these problems by providing an apparatus for sensing the presence of a sheet of material transported within a sheet-handling device. The apparatus includes a first member positionable within the sheet-handling device and relative to the sheet so that the transporting of the sheet causes movement of the first member. A light-emitter for emitting light is positionable relative to the first member so that movement of the first member causes movement of the light-emitter. An electro-optic sensor is positionable relative to the light-emitter to receive the light from the light-emitter. The electro-optic sensor includes a photosensitive zone in which a first photocurrent is created when light impinges on the photosensitive zone. The electro-optic sensor also includes a first electrode electrically connected to the photocurrent zone for transferring the first photocurrent from the photosensitive zone. A photocurrent receiver and equater is electrically connected to the first electrode for receiving the first photocurrent and equating the first photocurrent to the presence of the sheet.

Another embodiment of the present invention is an apparatus for sensing the presence of a sheet of material transported within a sheet-handling device. This embodiment includes a first member positionable within the sheet-handling device and relative to the sheet so that the transporting of the sheet causes movement of the first member. An optical fiber has a first fiber end and a second fiber end. The first fiber end is positionable relative to the first member so that movement of the first member causes movement of the first fiber end. A light source is positionable relative to the second fiber end so that light from the light source enters the second fiber end and exits the first fiber end. An electro-optic sensor is positionable relative to the first fiber end to receive the light from the optical fiber. The electro-optic sensor includes a photosensitive zone in which a first photocurrent is created when light impinges on the photosensitive zone. A photocurrent receiver and equater is electrically connected to the photosensitive zone for receiving the first photocurrent and equating the first photocurrent to the presence of the sheet.

Another embodiment of the present invention is an apparatus for determining the number of sheets present within a sheet-handling apparatus. The apparatus includes a first roller and a second roller. The first roller is moveable between a first roller position and a second roller position when at least one of the sheets is present between the first roller and the second roller. A first arm is positioned relative to the first roller so that movement of the first roller causes movement of the first arm. A second arm is positioned relative to the first arm so that movement of the first arm causes movement of the second arm. The second arm is moveable between a first arm position and a second arm position. The second arm is biased to the first arm position. A light emitter is positioned relative to the second arm so that movement of the second arm causes movement of the light-emitter. An electro-optic sensor is positioned to receive the light from the light-emitter. The electro-optic sensor includes a photosensitive zone in which a first photocurrent is created when light impinges on the photosensitive zone. The electro-optic sensor also includes a first electrode electrically connected to the photocurrent zone for transferring the first photocurrent from the photosensitive zone. A photocurrent receiver and equater receives the first photocurrent and equates the magnitude of the first photocurrent to the number of sheets present between the first roller and the second roller.

Another embodiment of the present invention is an apparatus for developing a sheet of thermal-sensitive material. This apparatus includes a transporter for transporting the sheet within the apparatus. A heater for heating the sheet receives the sheet from the transporting means and develops the sheet. A sheet indicator indicates the absence or presence of the sheet prior to being transported to the heating means. The sheet sensor includes a first roller and a second roller adjacent to the first roller. The first roller is moveable when at least one of the sheets passes between the first roller and the second roller. The sheet indicator also includes a first member positionable relative to the first roller so that movement of the first roller causes movement of the first member. The sheet indicator also includes a light-emitter for emitting light positioned relative to the first member so that movement of the first member causes movement of the light-emitter. The sheet indicator also includes an electro-optic sensor positioned to receive the light from the light-emitter. The electro-optic sensor includes a photosensitive zone in which a first photocurrent is created when light impinges on the photosensitive zone. The electro-optic sensor also includes a first electrode electrically connected to the photocurrent zone for collecting the first photocurrent from the photosensitive zone. The sheet indicator also includes a photocurrent receiver and equater for receiving the photocurrent from the first electrode and equating the magnitude of the first photocurrent to absence or presence of the sheet.

Another embodiment of the present invention is a method for sensing the presence of a sheet of material transported within a sheet-handling apparatus. This method includes the step of transporting the sheet toward a first member positioned within the sheet-handling apparatus so that the sheet causes movement of the first member. Another step of this method includes emitting light from a light-emitter which is positioned relative to the first member so that movement of the first member causes movement of the light-emitter. Another step of this method is receiving the light from the light-emitter when the light emitting means is moved by movement of the first member. The step of receiving the light uses an electro-optic sensor which includes a photosensitive zone in which a first photocurrent is created when light impinges on the photosensitive zone. The electro-optic sensor also includes a first electrode electrically connected to the photocurrent zone for transferring the first photocurrent from the photosensitive zone. Another step of this method is receiving the first photocurrent from the first electrode and equating the first photocurrent to the movement of the first member.

Another embodiment of the present invention is a method for electro-optically determining the number of sheets being transported to a particular location within a sheet-handling apparatus. This method includes the step of transporting at least one of the sheets between a first roller and a second roller positioned within the sheet-handling apparatus causing movement of the first roller. The first roller is positioned relative to a first arm so that the movement of the first roller causes movement of the first arm. Another step includes emitting light from a light-emitter positioned relative to the first arm so that movement of the first arm causes movement of the light-emitter. Another step of this method is receiving the light from the light-emitter when the light-emitting means is moved by movement of the first arm. The step of receiving the light uses an electro-optic sensor which includes a photosensitive zone in which a first photocurrent is created when light impinges on the photosensitive zone. The electro-optic sensor also includes a first electrode electrically connected to the photocurrent zone for transferring the first photocurrent from the photosensitive zone. Another step within this method is receiving the first photocurrent from the first electrode and equating the magnitude of the first photocurrent to the number of sheets being transported between the first and second rollers.

Another embodiment of the present invention includes a method for determining the location of a sheet-feeding mechanism within a sheet-handling apparatus so that the sheet-feeding mechanism accurately feeds a sheet between a first member and a second member. The first member is positioned above the second member, and the method includes lowering the first member so that the first member contacts the second member. The position of the first member when contacting the second member as a baseline position is stored. The first member is raised away from the second member to a first position forming a gap between the first member and the second member. The sheet is inserted into the gap. The first member is allowed to be moved toward the second member from the first position to a second position, wherein the second position is where the first member is stopped by the sheet. A first actual displacement value, the difference between the second position and the baseline position, is determined. The first member is raised from the sheet. The sheet-feeding mechanism is lowered relative to the first member and second member so that the sheet is moved toward the second member. The first member is allowed to be moved to a third position, wherein the third position is where the first member is stopped by the sheet. A second actual displacement value, the difference between the third position and the baseline position, is determined. The first actual displacement value is compared to the second actual displacement value. The sheet-feeding mechanism is incrementally lowered and corresponding actual displacement values are determined to determine the location of the sheet-feeding mechanism which results in the least actual displacement value. Then, the sheet-feeding mechanism is positioned at the location which causes the least actual displacement value.

BRIEF DESCRIPTION OF THE DRAWINGS

The foregoing advantages, construction, and operation of the present invention will become more readily apparent from the following description and accompanying drawings in which.

DETAILED DESCRIPTION

Figure 1:
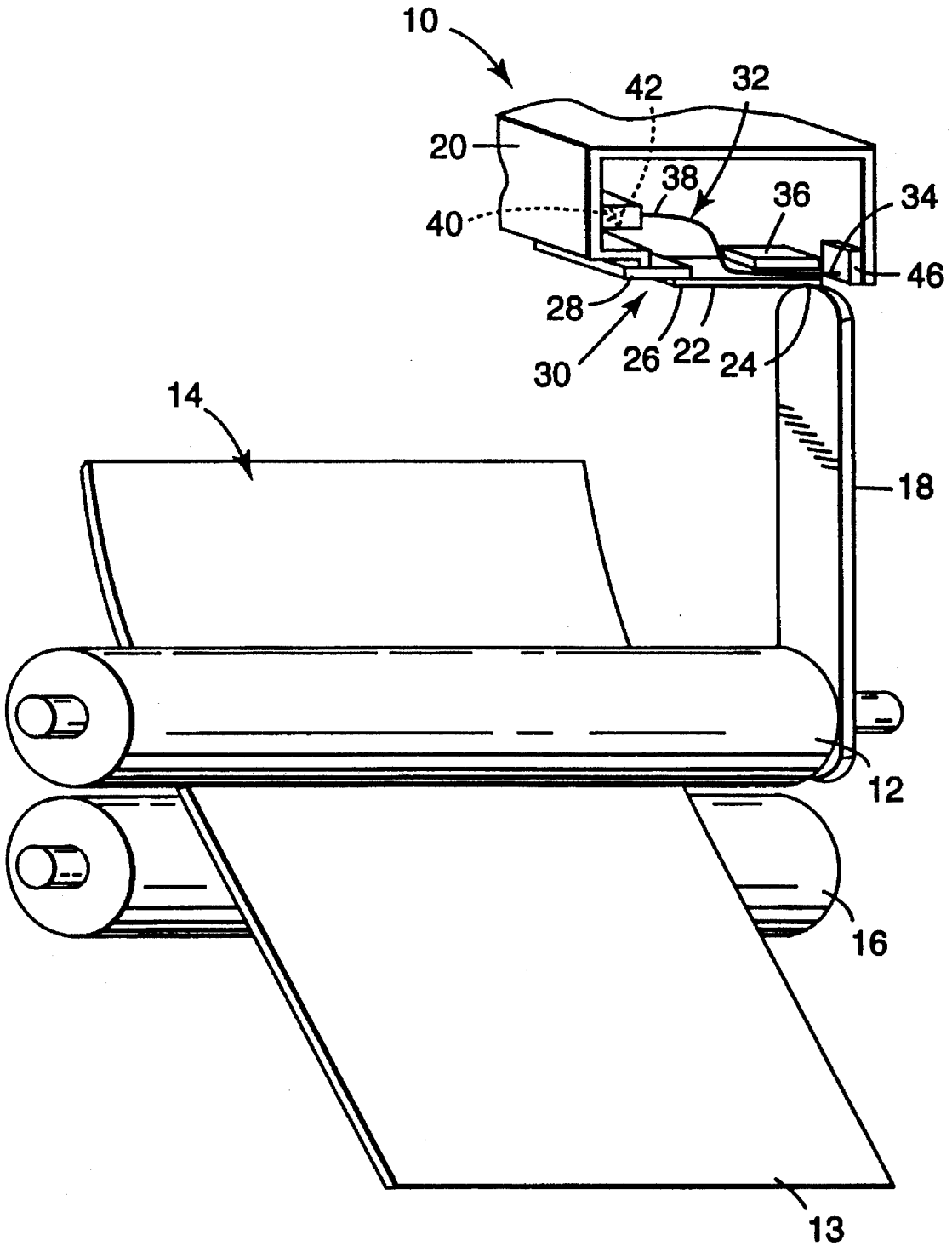
FIG. 1 is a perspective view of one embodiment of the electro-optic sheet-sensing apparatus, including a cross-sectional view of one portion of the electrooptic sheet-sensing apparatus.

One embodiment of a electro-optic sheet-sensing apparatus 10 is adapted for sensing the movement of an object, such as the first roller 12 shown in FIG. 1. The electro-optic sheet-sensing apparatus 10 can sense the movement or displacement of a first roller 12 within a sheet-handling apparatus (not shown in FIG. 1) when the first roller 12 contacts, for example, the leading edge 13 of a sheet 14 of material or a plurality of sheets 14. A broad array of sheet types can be sensed with the electro-optic sheet-sensing apparatus 10 including papers, polymeric films, metallic sheets, transparent and opaque sheets, photosensitive and heat-sensitive sheets, and more specifically recording media, such as photothermographic sheets.

The first roller 12 is shown adjacent to a second roller 16 between which a sheet 14 is passing. The first and second rollers 12, 16 can be drive rollers for advancing the sheet 14. The presence of one or more sheets 14 between the first and second rollers 12, 16 causes the first roller 12 to be moved or separated from the second roller 16. The magnitude of the movement or separation is determined by the number of sheets 14 inserted between the first and second rollers 12, 16.

The electro-optic sheet-sensing apparatus 10 is shown as including a first arm 18 which is positioned relative to the first roller 12 so that movement of the first roller 12 causes movement of the first arm 18. In FIG. 1, the first arm 18 is shown as being connected to one end of the first roller 12.

The first arm 18 is positioned relative to a sensor housing 20 which includes a second arm 22, so that movement of the first arm 18 causes movement of the second arm 22. The first arm 18 and the second arm 22 can be connected or just in close proximity with each other.

The second arm 22 has a first arm end 24 and a second arm end 26. The second arm end 26 is shown as being connected to the sensor housing 20 by a spring 28. The connection of the spring 28, the sensor housing 20, and the second arm 22 creates a flexure joint 30 which allows the first arm end 24 to move between a first and a second position. The flexure joint 30 also accurately biases the first arm end 24 toward the first position. The flexure joint 30 can repetitively and accurately return the first arm end 24 to the first position when a sheet 14 is not present between the first and second rollers 12, 16.

An optical fiber 32 is positioned relative to and can be connected to the second arm 22 near the first arm end 24 so that movement of the first arm end 24 causes movement of a first fiber end 34 of the optical fiber 32. The first fiber end 34 is shown as being connected to the second arm 22 near the first arm end 24 by being captured between the second arm 22 and a fiber-holding plate 36. The second fiber end 38 of the optical fiber 32 can be positioned adjacent to a light-emitter, such as the light-emitting diode (LED) 40.

An example of the LED 40 is a Model SFH450 plastic fiber optic transmitter diode supplied by Siemens and designed to function with a 2.2 millimeter, clad, 1000 micron optical fiber. This LED 40 includes a lens 42, which is molded into place to focus light from the LED 40 into the second fiber end 38. The lens 42 improves the optical coupling efficiency causing a greater quantity of light to enter the optical fiber 32 and travel through to the first fiber end 34.

An example of the optical fiber 32 used is a Model Super Eska SK-20 optical fiber (unarmored, clad, 0.50 millimeter) supplied by Mitsubishi Rayon Corporation. This optical fiber provides a compromise between mechanical compliance and optical coupling efficiency. A 0.25 millimeter fiber has also been shown to work and decreases the light spot size which improves the dynamic range of the electro-optic sheet-sensing apparatus 10.

Figure 2:
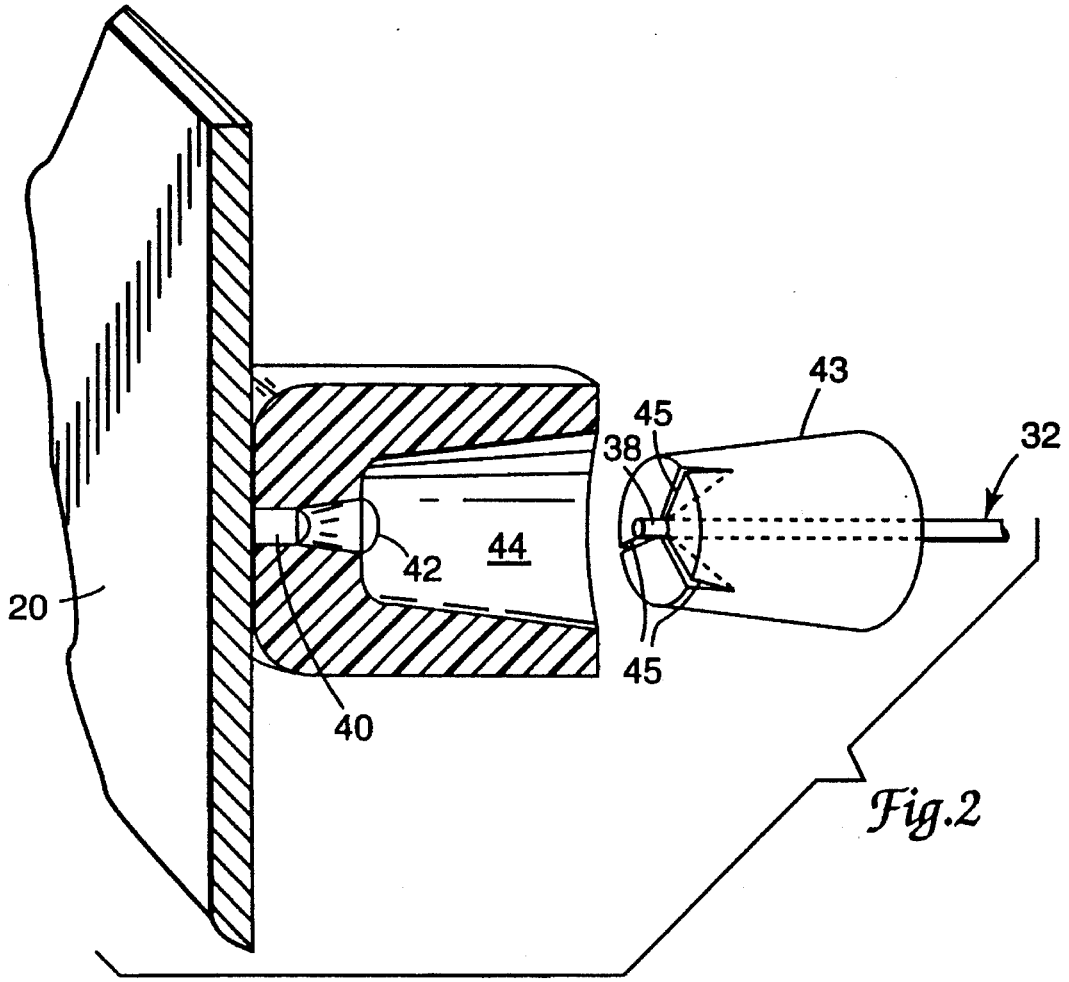
FIG. 2 is a perspective view of a centering bushing and a light-emitting diode within the electro-optic sheet-sensing apparatus shown in FIG. 1, just before the centering bushing is inserted into the diode.

For simple and accurate positioning of the second fiber end 38 relative to the LED 40, the electro-optic sheet-sensing apparatus 10 can include a positioner, such as the centering bushing 43 shown in FIGS. 1 and 2. When the centering bushing 43 is inserted and press-fit into a tapered housing 44 of the LED, the grooves 45 within the centering bushing 43 are collapsed to fit tightly with the tapered housing 44. This fit can eliminate the need for a more permanent joining means, such as an adhesive, and allows for removal of the centering bushing 43 from the tapered housing 44 if disassemble is ever necessary. This fit also centers the second fiber end 38 relative to the centerpoint of the LED 40 which is important for optimizing the optical coupling efficiency between the LED 40 and the optical fiber 32. This centering effect can be particularly important to compensate for inherent dimensional tolerances within the mating walls of the tapered housing 44 and the centering bushing 43.

The light from the LED 40 exits the first fiber end 34 and can impinge upon a position sensing device (PSD) 46 due to the position of the first arm end 24 and the first fiber end 34 relative to the PSD 46. In addition to the diameter of the optical fiber 32, the distance between the first fiber end 34 and the PSD 46 determines the size of the incident light spot S and the dynamic range of the electro-optic sheet-sensing apparatus 10.

Figure 3:
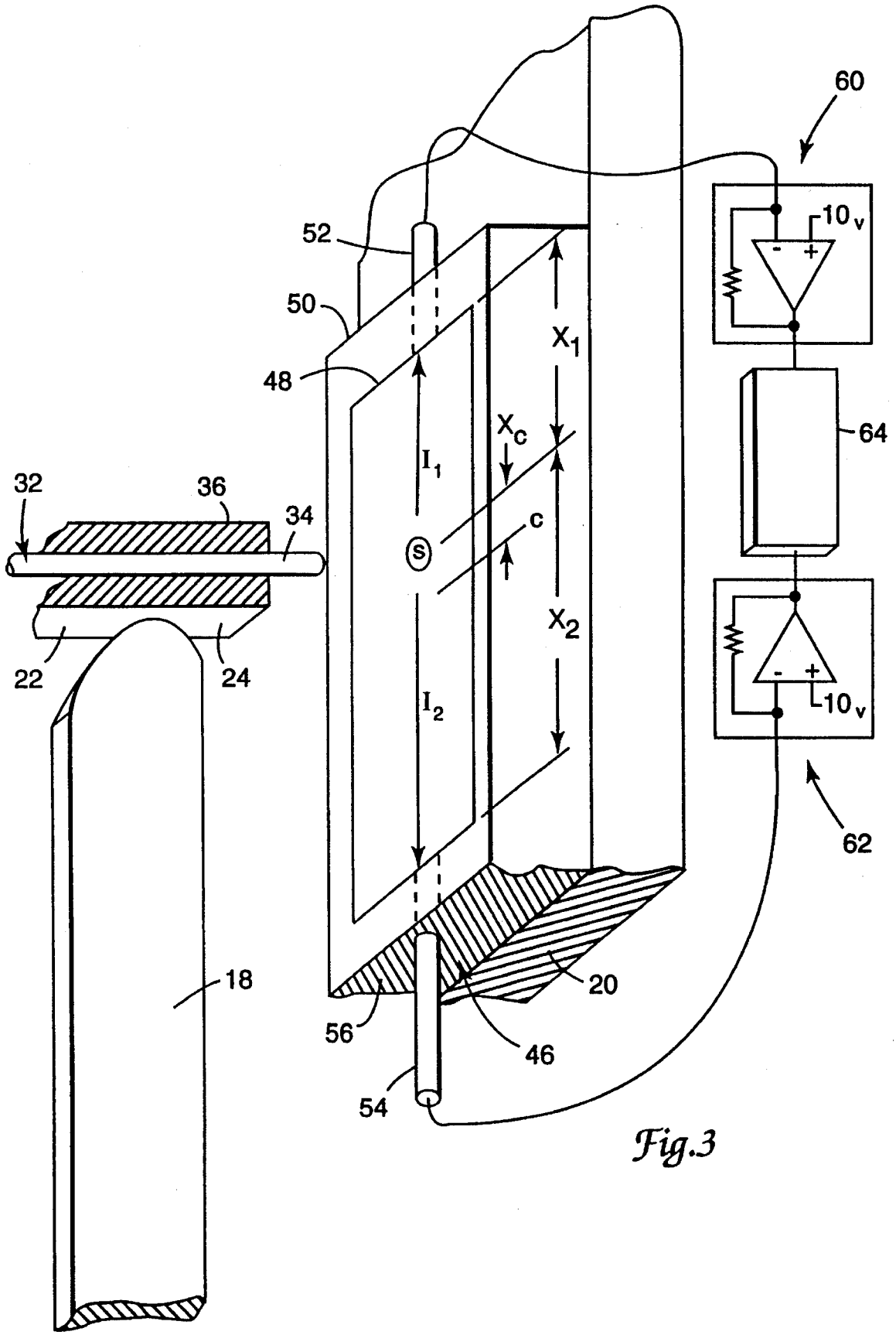
FIG. 3 is a perspective schematic view of the position sensing device (PSD), amplifiers, and a control board within the electro-optic sheet-sensing apparatus shown in FIG. 1.

An example of the PSD 46 used is a Model S3274 PSD supplied by Hamamatsu Corporation shown in FIG. 3. This PSD 46 includes a photosensitive zone 48 which, when impinged with an incident light spot S, creates a first photocurrent $I_1$ proportional to the light energy. The first photocurrent $I_1$ travels through the resistive photosensitive zone 48 and is collected at a first sensor end 50 by a first electrode 52, or photocurrent collector. Because the resistivity of the photosensitive zone 48 can be uniform, the magnitude of the first photocurrent $I_1$ collected by the first electrode 52 is inversely proportional to the distance $x_1$ between the incident position and the first electrode 52. The magnitude of the first photocurrent $I_1$ can be equated to an absolute magnitude of the movement of the first roller 12.

The photosensitive zone 48, when impinged with the light spot, can also create a second photocurrent $I_2$ which travels to a second electrode 54 located at the second sensor end 56. The magnitude of the second photocurrent $I_2$ is inversely proportional to the distance $x_2$ between the incident position and the second electrode 54. With the measurement of two photocurrent $I_1$, $I_2$, the position of the incident light spot S on the PSD 46 can be determined, as can the relative magnitude of the movement of the first roller 12. This relative measurement approach is useful to compensate for or minimize the effect of electro-optical noise and/or drift.

To determine the position of the incident light spot S relative to the first electrode 52 ($=x_1$), the following formula can be used:

$$X_1=L_2/(I_1+I_2),$$

where L is the distance between the first electrode 52 and the second electrode 54.

For another example, to determine the position of the incident light spot S relative to the centerpoint C between the first electrode and second electrode ($=x_c$), the following formula can be used:

$$x_c=L/2-(L\,I_2/(I_1+I_2)).$$

Amplifiers 60, 62 and a control board 64 (a programmable controller) can be used with the PSD 46 to receive, convert, and equate the photocurrents using the above-noted formulas. These additional components 60, 62, 64 determine whether the incident light spot S has moved due to movement of the optical fiber 32. With movement of the optical fiber 32, the $x_c$ will change. The magnitude of the change of $x_c$ can be used to determine the magnitude of the movement or displacement of the optical fiber 32 and the displacement of the first roller 12. This movement, if measured as a function of time, can be used to determine the velocity and/or acceleration of the first roller 12.

Additionally, the ability to sense the magnitude of motion allows the electro-optic sheet-sensing apparatus 10 to sense the number of sheets passing between the first roller 12 and the second roller 16 at one time. To do this, a photocurrent $I_1$ is collected by the first electrode 52 and a photocurrent $I_2$ is collected by the second electrode 54. The amplifiers 62, 64, shown as having an offset voltage of 10 volts and a feedback resistor R, convert the photocurrents $I_1$, $I_2$ into voltages $V_1$, $V_2$, respectively. The control board 64 converts the analog voltages $V_1$, $V_2$ into corresponding digital values $D_1$, $D_2$, respectively.

To determine a baseline value B, that is, a digital value equated when no sheet 14 is present between the first roller 12 and the second roller 16 (causing no displacement of the first roller 12), the control board 64 applies the following formula (when no sheet is present) to determine the baseline value B:

$$B=((D_1-k)-(D_2-k)) / ((D_1-k)+(D_2-k)).$$

The term k is a constant used to offset the digital values $D_1$, $D_2$ due to the 10-volt offset voltage previously noted. Once the baseline value B has been established, the control board 64 can determine an actual value A using the same formula when the photothermographic apparatus 66 has attempted to insert a sheet 14 between the first and second rollers 12, 16. An actual displacement value $d_a$ is equated using the following formula:

$$\text{actual displacement value } d_a = \text{actual value A} - \text{baseline value B}.$$

An absence of a sheet 14 between the first roller 12 and the second roller 16 results no movement of the incident light spot S and an actual displacement value $d_a$ of zero. But, the presence of one or more sheets 14 causes movement of the incident light spot S and actual displacement value $d_a$ of the first roller 12.

The control board 64 can then compare the actual displacement value $d_a$ to a look-up table stored within the control board 64. The look-up table contains a column of stored displacement values $d_s$ and a corresponding column of number-of-sheet values $N_s$. Each stored displacement value $d_s$ corresponds to a particular number-of-sheet value $N_s$. This look-up table can be created based on repetitive testing.

As a result, when one sheet 14 is present and the actual displacement value $d_a$ is equated, the control board 64 will find the stored displacement value $d_s$ closest to the actual displacement value $d_s$. Then, the control board 64 will find the corresponding number-of-sheets $N_s$ within the look-up table to be one. The control board 64 can then send a signal to another component within a sheet-handling apparatus that one sheet 14 is present and/or that the other component should proceed with a particular process step.

Similarly, when no sheet 14 or more than one sheet 14 is present between the first roller 12 and the second roller 16, a different actual displacement value $d_a$ is equated by the control board 64 based on the previously noted formula. The control board 64 will, then, find the closest stored displacement value $d_s$ to the actual displacement value $d_a$ and the corresponding number-of-sheet value $N_s$. For example, when no sheet 14 is present, the control board 64 will determine from the actual displacement value $d_a$ (=zero) that the number-of-sheets value $N_s$ is zero. Or, if two sheets 14 are present, the control board 64 will determine from the actual displacement value $d_a$ that the number-of-sheets value $N_s$ is two. In either case, the control board 64 can send a signal to the other component that the incorrect number of sheets 14 is present and that a particular process step should be halted. Or, the control board 64 can determine that the actual displacement value $d_a$ is sufficiently different from a stored displacement value $d_s$ and that a particular activity should be halted.

To compensate for vibration or other factors possibly affecting the location of the incident light spot S, the control board 64 can receive multiple photocurrents (e.g., ten or more) when establishing a single baseline value B, or a single actual value A. The multiple photocurrents are then converted to digital values $D_1$, $D_2$ which can be averaged to obtain averaged digital values $D_{1\text{-}AVG}$, $D_{2\text{-}AVG}$. The averaged digital values $D_{1\text{-}AVG}$, $D_{2\text{-}AVG}$ can then be equated using the previously noted formulas to an actual displacement value $d_a$ which is less sensitive to vibration and other factors.

In addition to having the ability to determine when two or more stacked sheets 14 are being fed by sensing the increased thickness of the leading edge 13 of the sheets 14, the electro-optic sheet-sensing apparatus 10 can also sense when two are more staggered sheets are being fed. By staggered, it is meant that the leading edge 13 of the first of two sheets 14 travels between the first and second rollers 12, 16 before the leading edge 13 of second of the two sheets 14. To accomplish this, the electro-optic sheet-sensing apparatus 10 can sense dynamically. That is, the electro-optic sheet-sensing apparatus 10 can continually equate the actual displacement value $d_a$ to data within the look-up table as a sheet 14 travels between the first and second rollers 12, 16. With this approach, the staggered sheets would be sensed when the leading edge of the second sheet 14 travels between the first and second rollers 12, 16.

Alternatively, staggered sheets can be sensed using two electro-optic sheet-sensing apparatuses 10 which are separated by a distance which is slightly greater than the length of the sheet 14. With this spacing, staggered sheets 14 are sensed when both electro-optic sheet-sensing apparatuses simultaneously detect the presence of a sheet 14. Not relying on dynamic sensing, this approach is less affected by mechanical noise within the electro-optic sheet-sensing apparatus 10 caused by, for example, bearing noise or the lack of roundness of the first and second rollers 12, 16.

Figure 4:
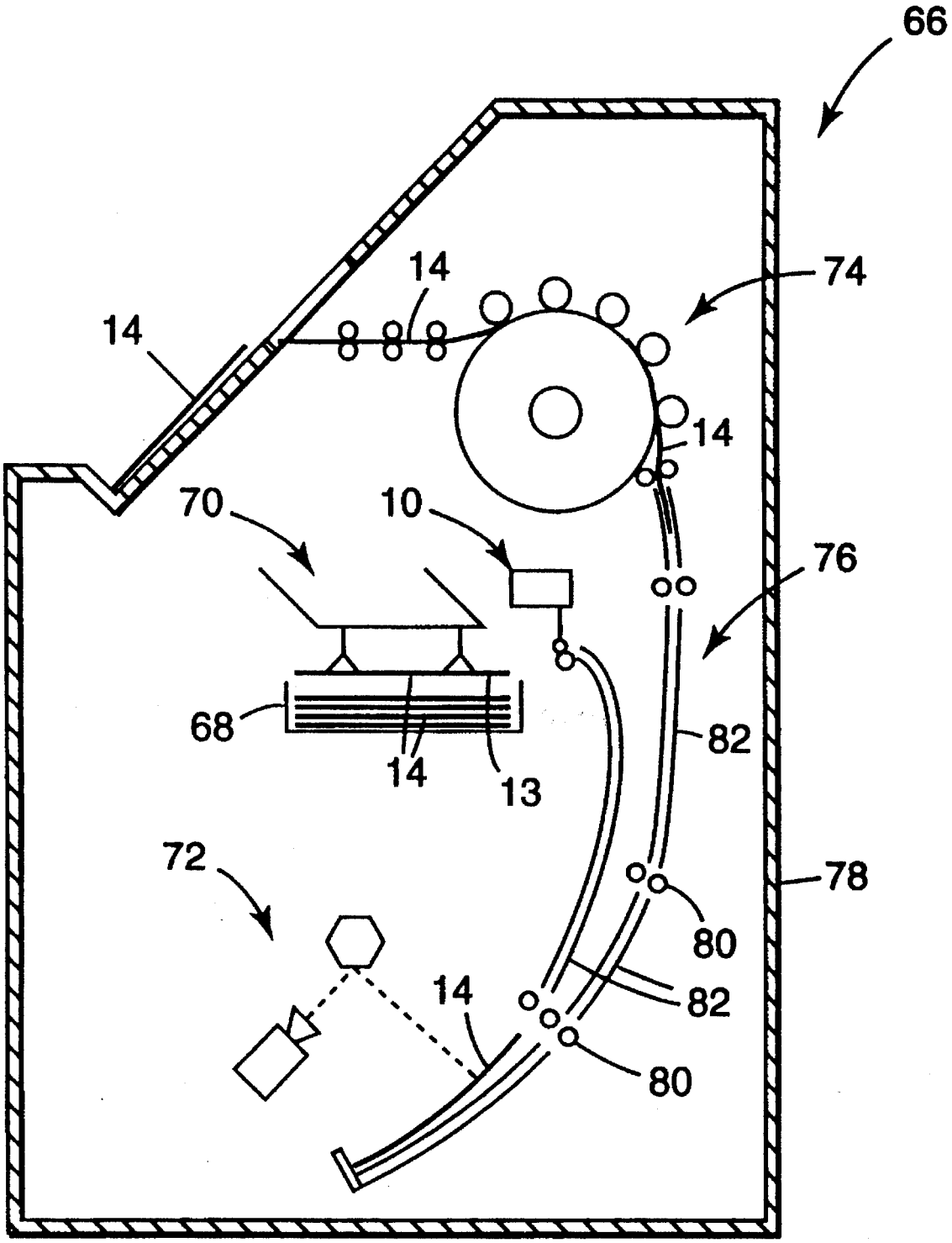
FIG. 4 is a schematic view of a photothermographic apparatus including the electro-optic sheet-sensing apparatus shown in FIG. 1.

The previously-described embodiments of the electro-optic sheet-sensing apparatus 10 can be a part of a larger apparatus, such as the photothermographic imaging apparatus 66 shown in FIG. 4. To process a sheet 14 of photothermographic material, the photothermographic imaging apparatus 66 includes a sheet container 68, a sheet-feeding mechanism 70, exposing station 74, developing station 72, and a transporting mechanism 76, each of which is contained within a housing 78. Having a plurality of suction cups 79, the sheet-feeding mechanism 70 can withdraw a sheet 14 from the sheet container 68 and advance the sheet 14 to between the first and second rollers 12, 16 so that the electro-optic sheet-sensing apparatus 10 can determine whether a single sheet 14 is present. When more than a single sheet 14 is sensed, the sheet-sensing apparatus 10 can instruct the first and second rollers 12, 16 to rotate in a direction so that the sheets 14 drop back into the sheet container 68.

When only a single sheet 14 is sensed, the first and second rollers 12, 16 can rotate in the opposite direction to advance the sheet 14 to the transporting mechanism 76. With a series of transporting rollers 80 and guide chutes 82, the transporting mechanism 76 can advance the sheet 14 to the exposing station 74 which can expose the sheet 14 to an image-wise pattern of radiation to create a first or latent image. The transporting mechanism 76 can then transport the sheet 14 from the exposing station 74 to the developing station which can heat the sheet 14 for a sufficient time and to a sufficient temperature to develop the first image to a visible image.

The electro-optic sheet-sensing apparatus 10 can also be useful when the photothermographic apparatus 66 is designed to functions properly when a sheet 14 is not present within a particular position at a particular time. For example, proper use of the photothermographic apparatus 66 may require that no sheet 14 be developed within the developing station 68 when another sheet 14 is being laser-scanned or exposed within the exposing station 70. This can be another means of reducing the vibration of the exposing station 70 by the motion within the developing station 72. To do this, the electro-optic sheet-sensing apparatus 10 can send a "go" signal to the exposing station 72 when no sheet 14 is sensed within the developing station 70.

Because sheet-handling apparatuses, such as the photothermographic imaging apparatus 66, preferably can process sheets of different thicknesses, the electro-optic sheet-sensing apparatus 10 is adaptable to function with a type of sheet 14 having a particular thickness and another type of sheet having a different thickness. This can be accomplished by having a sheet-identifying system (not shown) within, for example, the photothermographic apparatus and a plurality of look-up tables within the control board 64. When the sheet-identifying system detects the type and/or thickness of the sheet 14 being fed into the photothermographic apparatus 66, the photothermographic apparatus 66 can instruct the electro-optic sheet-sensing apparatus 10 to consult a particular look-up table which corresponds to the thickness of the particular sheet 14. One such sheet-identifying system can read a bar code (not shown) on the sheet container 68 which identifies the sheet type and/or thickness.

Figure 5:
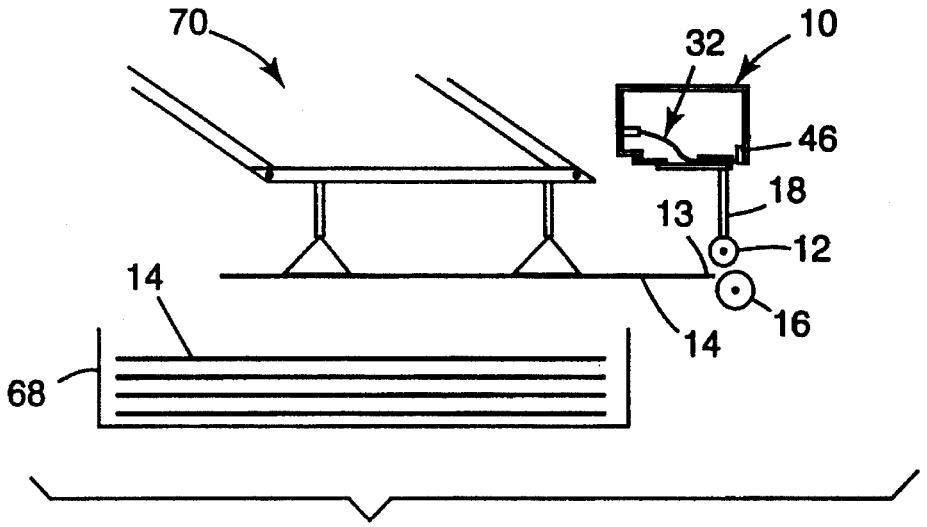
FIG. 5 is a schematic perspective view of the electro-optic sheet-sensing apparatus of FIG. 1 being used to calibrate a sheet pick-up mechanism.

In addition to sensing the presence or absence of a sheet 14, the electro-optic sheet-sensing apparatus 10, as shown in FIG. 5, can be used to position the sheet-feeding mechanism 70 at a target position. This is intended to insure proper placement of the sheet 14 between the first and second rollers 12, 16. Before a sheet 14 is inserted between the first and second rollers 12, 16 by the sheet-feeding mechanism 70, the first roller 12 can be lowered to contact the second roller 16. This position is known to the electro-optic sheet-sensing device 10 as a baseline position. When a sheet 14 is being advanced by the sheet-feeding mechanism 70 toward the first and second rollers 12, 16, the first roller 12 can be raised from the second roller 16 by, for example, a solenoid-driven mechanism (not shown). This forms a gap between the first and second rollers 12, 16 which is sufficiently larger than the thickness of a single sheet 14. The sheet-feeding mechanism 70 can be initially instructed by, for example, a programmable controller (hereinafter, the PC; not shown), which communicates with the electro-optic sheet-sensing apparatus 10, to advance the leading edge 13 to a first predetermined position P1 between the first and second rollers 12, 16, but closer to the first roller 12. The sheet 14 is then lowered toward the second roller 16 to a second predetermined position P2. The first roller 12 can then be lowered so that the first roller 12 strikes the sheet 14 and stops due to the beam strength of the sheet 14. The electro-optic sheet-sensing apparatus 10 can sense and determine the actual displacement value (i.e., the distance, or difference, from the baseline position) of the first roller 12.

Then, the PC can raise the first roller 12 from the sheet 14. The PC can instruct the sheet-feeding mechanism 70 to lower the sheet 14 to a third predetermined position P3 which is closer to the second roller 16. Subsequently, the first roller 12 can be lowered until the first roller 12 again strikes the sheet 14 and stops. The electro-optic sheet-sensing apparatus 10 can determine the actual displacement value of the first roller 12.

This incremental lowering of the sheet 14 eventually positions the sheet 14 at the tangent point. The tangent point is where the sheet 12 is tangent to the first and second rollers 12, 16 when contacting the first and second rollers 12, 16. As the tangent point is approached, the actual displacement value of the first roller 12 is minimized. This occurs because the first roller 12 is stopped decreasingly by the beam strength of the sheet 12, but increasingly by the sheet 14 being backed up by the second roller 16.

If the incremental lowering of the sheet 14 is continued beyond this tangent point, the actual displacement value increases. This increase occurs because the first roller 12 will be stopped increasingly by the beam strength of the sheet 14. When the actual displacement value increases after sheet 14 has passed the tangent point, the PC can store the previous sheet-feeding mechanism position, which corresponds to the tangent point, as the target position. Once stored, the target position can be used in subsequent sheet-feeding steps.

To minimize the effect of noise on the determination of the actual displacement values by the electro-optic sheet-sensing apparatus 10, numerous actual displacement values can be taken and processed by the PC and the electro-optic sheet-sensing apparatus 10. The electro-optic sheet sensing apparatus 10 can include a stored displacement value which is preselected to be somewhat greater than the expected actual displacement value at the tangent point. As the sheet 14 is lowered toward the tangent point, the actual displacement values will fall below the stored displacement value. This first cross-over position of the sheet-feeding mechanism 70 can be stored by the PC. As the sheet is lowered beyond the tangent point, the actual displacement values will rise above the stored displacement value. This second cross-over position of the sheet-feeding mechanism 70 can also be stored by the PC. Then, the PC can establish the mid-point between the first and second cross-over positions as the target position of the sheet-feeding mechanism 70. Not only does this minimize the effect of noise, this process also eliminates the need to determine a large number of actual displacement values and precisely find the target position of the sheet-feeding mechanism 70.

This positioning or calibrating process can be repeated, for example, each time the electro-optic sheet-sensing apparatus is turned on. Also, this process can be automatically repeated when the PC, for some reason, loses the data corresponding to the target position. In addition, sheet-sensing apparatuses other than the electro-optical sheet-sensing apparatus can be used within this positioning process.

Many other embodiments and uses similar to those previously stated are apparent and contemplated by the inventors. For example, the electro-optic sheet-sensing apparatus 10 can include a component other than first roller 12 for contacting the sheet 14, such as a belt, a bar, or another member having a sheet-contacting surface. In addition, the electro-optic sheet-sensing apparatus can be useful within other sheet-handling or sheet-processing apparatus, other than the photothermographic apparatus 66, such as in photocopiers, laser printers, and the like. Plus, the electro-optic sheet-sensing apparatus 10 can be used with rolls of material rather than sheets 14.

What is claimed is:

1. An apparatus for sensing the presence of a sheet of material transported within a sheet-handling device, comprising:

a first member positionable within the sheet-handling device and relative to the sheet so that the transporting of the sheet causes movement of the first member;

light-emitting means for emitting light, wherein the light-emitting means is positionable relative to the first member so that movement of the first member causes movement of the light-emitting means;

an electro-optic sensor positionable relative to the light-emitting means to receive the light from the light-emitting means, wherein the electro-optic sensor comprises:

a photosensitive zone in which a first photocurrent is created when light impinges on the photosensitive zone; and a first electrode electrically connected to the photocurrent zone for transferring the first photocurrent from the photosensitive zone; and photocurrent receiving and equating means electrically connected to the first electrode for receiving the first photocurrent and equating the first photocurrent to the presence of the sheet.

2. The apparatus of claim 1, wherein the equating means equates the first photocurrent to the presence of the sheet by converting the first photocurrent to a data value and by comparing the data value to a stored value.

3. The apparatus of claim 2, wherein the electro-optic sensor further comprises:

a first sensor end and a second sensor end between which the photosensitive zone is located, and wherein the first electrode is electrically connected to the photosensitive zone at the first end; and a second electrode located at the second sensor end and electrically connected to the photosensitive zone, wherein light impinging on the photosensitive zone creates a second photocurrent transferred by the second electrode, wherein the magnitude of the first photocurrent is inversely proportional to the distance from where the light impinges on the photosensitive zone to the first electrode, wherein the magnitude of the second current is inversely proportional to the distance from where the light impinges on the photosensitive zone to the second electrode.

4. The apparatus of claim 3, wherein the equating means comprises:

a first amplifier which converts the first photocurrent to a first voltage value;

a second amplifier which converts the second photocurrent to a second voltage value; and a control board which converts the first voltage value to a first digital value and the second voltage value to a second digital value, wherein the control board equates the data value from the first and the second digital values.

5. The apparatus of claim 4, wherein the control board can determine a difference between the data value and the stored value, wherein the difference is known to equate to a magnitude of movement of the first member.

6. The apparatus of claim 5, wherein the movement of the first member created by the presence of one sheet of material produces the difference between the data value and the stored value which is approximately equal to a first actual displacement value, and wherein the first actual displacement value is known to equate to the movement caused by the presence of one sheet of material.

7. The apparatus of claim 5, wherein the movement of the first member created by the presence of a number of sheets of material produces a difference between the data value and the stored value which is at least approximately equal to a second final value, wherein the second final value is known to equate to the movement caused by the presence of more than one sheet of material.

8. The apparatus of claim 5, wherein no movement of the first member due to the absence of a sheet of material produces a difference between the data value and the stored value which is approximately equal to a third final value, wherein the third final value is known to equate to an absence of a sheet.

9. The apparatus of claim 1, wherein the first member comprises a first roller and a second roller, wherein the first and second rollers are adjacent and substantially parallel, and wherein the movement of the sheet between the first and second roller causes movement of the first roller.

10. The apparatus of claim 9, wherein the first roller has a first roller end, and wherein the first member further comprises:

a first arm positionable relative to the first roller so that movement of the first roller causes movement the first arm;

a second arm positionable relative to the first arm so that movement of the first arm causes movement of the second arm, wherein the second arm is moveable between a first position and a second position; and a spring which biases the second arm to the first position when no sheet is present between the first roller and the second roller.

11. An apparatus for sensing the presence of a sheet of material transported within a sheet-handling device, comprising:

a first member positionable within the sheet-handling device and relative to the sheet so that the transporting of the sheet causes movement of the first member;

an optical fiber having a first fiber end and a second fiber end, wherein the first fiber end is positionable relative to the first member so that movement of the first member causes movement of the first fiber end;

a light source positionable relative to the second fiber end so that light from the light source enters the second fiber end and exits the first fiber end;

an electro-optic sensor positionable relative to the first fiber end to receive the light from the optical fiber, wherein the electro-optic sensor comprises a photosensitive zone in which a first photocurrent is created when light impinges on the photosensitive zone; and photocurrent receiving and equating means electrically connected to the photosensitive zone for receiving the first photocurrent and equating the first photocurrent to the presence of the sheet.

12. The apparatus of claim 11, wherein the apparatus further comprises:

a housing in which the light source is located;

a lens located within the housing and positionable between the light source and the second fiber end, wherein the lens has a centerpoint; and a positioner insertable within the housing for positioning the second fiber end adjacent to the centerpoint of the lens.

13. The apparatus of claim 12, wherein the positioner includes grooves which are collapsible about the optical fiber when the positioner is inserted into the housing.

14. An apparatus for determining the number of sheets present within a sheet-handling apparatus, comprising:

a first roller and a second roller, wherein the first roller is moveable between a first roller position and a second roller position when at least one of the sheets is present between the first roller and the second roller;

a first arm positioned relative to the first roller so that movement of the first roller causes movement of the first arm;

a second arm positioned relative to the first arm so that movement of the first arm causes movement of the second arm, wherein the second arm is moveable between a first arm position and a second arm position;

biasing means for biasing the second arm to the first arm position;

light-emitting means for emitting light, wherein the light-emitting means is positioned relative to the second arm so that movement of the second arm causes movement of the light-emitting means;

an electro-optic sensor positioned to receive the light from the light-emitting means, wherein the electro-optic sensor comprises:

a photosensitive zone in which a first photocurrent is created when light impinges on the photosensitive zone; and a first electrode electrically connected to the photocurrent zone for transferring the first photocurrent from the photosensitive zone; and photocurrent receiving and equating means for receiving the first photocurrent and equating the magnitude of the first photocurrent to the number of sheets present between the first roller and the second roller.

15. An apparatus for creating a visible image on a photothermographic sheet, comprising:

a housing;

a sheet container positionable within the housing for containing at least one photothermographic sheet;

a sheet-feeding mechanism positioned within the housing adjacent to the photothermographic sheet container for removing the photothermographic sheet from the sheet container;

transporting means positioned within the housing and adjacent to the sheet-feeding mechanism so that the transporting means can receive the photothermographic sheet from the sheet-feeding mechanism and transport the photothermographic sheet within the apparatus;

exposing means positioned within the housing adjacent to the transporting means so that the exposing means can receive the photothermographic sheet from the transporting means and expose the photothermographic sheet to an image-wise pattern of radiation to create a first image in the photothermographic sheet;

heating means positioned within the housing adjacent to the transporting means so that the heating means can receive the photothermographic sheet from the exposing means and heat the photothermographic sheet, wherein heat from the heating means develops the first image into the visible image on the photothermographic sheet; and a sheet sensor which senses the absence or presence of the photothermographic sheet prior to being transported to the exposing means, wherein the sheet sensor comprises:

a first roller and a second roller adjacent to the first roller, wherein the first roller is moveable when at least one of the photothermographic sheets passes between the first roller and the second roller;

a first member positioned relative to the first roller so that movement of the first roller causes movement of the first member;

light-emitting means for emitting light positioned relative to the first member so that movement of the first member causes movement of the light-emitting means;

an electro-optic sensor positioned to receive the light from the light-emitting means, wherein the electro-optic sensor comprises:

a photosensitive zone in which a first photocurrent is created when light impinges on the photosensitive zone; and a first electrode electrically connected to the photocurrent zone for collecting the first photocurrent from the photosensitive zone; and photocurrent receiving and equating means for receiving the photocurrent from the first electrode and equating the magnitude of the first photocurrent to absence or presence of the photothermographic sheet.

16. A method for sensing the presence of a sheet of material transported within a sheet-handling apparatus, comprising the steps of:

transporting the sheet toward a first member positioned within the sheet-handling apparatus so that the sheet causes movement of the first member;

emitting light from a light-emitting means which is positioned relative to the first member so that movement of the first member causes movement of the light-emitting means;

receiving the light from the light-emitting means when the light emitting means is moved by movement of the first member, wherein the step of receiving the light uses an electro-optic sensor which includes:

a photosensitive zone in which a first photocurrent is created when light impinges on the photosensitive zone; and a first electrode electrically connected to the photocurrent zone for transferring the first photocurrent from the photosensitive zone; and receiving the first photocurrent from the first electrode and equating the first photocurrent to the movement of the first member.

17. A method for electro-optically determining the number of sheets being transported to a particular location within a sheet-handling apparatus, comprising the steps of:

transporting at least one of the sheets between a first roller and a second roller positioned within the sheet-handling apparatus causing movement of the first roller, wherein the first roller is positioned relative to a first arm so that the movement of the first roller causes movement of the first arm;

emitting light from a light-emitting means positioned relative to the first arm so that movement of the first arm causes movement of the light-emitting means;

receiving the light from the light-emitting means when the light-emitting means is moved by movement of the first arm, wherein the step of receiving the light uses an electro-optic sensor which includes:

a photosensitive zone in which a first photocurrent is created when light impinges on the photosensitive zone; and a first electrode electrically connected to the photocurrent zone for transferring the first photocurrent from the photosensitive zone; and receiving the first photocurrent from the first electrode and equating the magnitude of the first photocurrent to the number of sheets being transported between the first and second rollers.

18. The method of claim 17, wherein the steps of emitting, receiving, and equating are repeated a plurality of times without a sheet being inserted between the first and second rollers to produce a plurality of baseline photocurrents, and wherein the method further comprises the steps of:

converting the baseline photocurrents to a plurality of baseline data values; and averaging the plurality of baseline data values to an average baseline data value.

19. The method of claim 18, wherein the steps of emitting, receiving, and equating are repeated a plurality of times after the sheet-handling apparatus has attempted to insert a sheet between the first and second rollers to produce a plurality of actual photocurrents, and wherein the method further comprises:

converting the actual photocurrents to a plurality of actual data values; and averaging the plurality of actual data values to an average actual data value.

20. The method of claim 17, wherein the step of emitting light comprises:

positioning a first end of an optical fiber adjacent to a light source so that light enters the first end of the optical fiber and exits the second end of the optical fiber; and positioning the second end of the optical fiber adjacent to the electro-optic sensor so that the light exiting the second end can impinge on a spot within the photosensitive zone.

* * * * *